US010519726B2

(12) United States Patent
Berry et al.

(10) Patent No.: US 10,519,726 B2
(45) Date of Patent: Dec. 31, 2019

(54) CASING RACKING MODULE

(71) Applicant: Schlumberger Technology Corporation, Sugar Land, TX (US)

(72) Inventors: Joe Rodney Berry, Cypress, TX (US); Robert Metz, Cypress, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 5 days.

(21) Appl. No.: 15/310,118

(22) PCT Filed: Nov. 9, 2016

(86) PCT No.: PCT/US2016/061027

§ 371 (c)(1),
(2) Date: Nov. 10, 2016

(87) PCT Pub. No.: WO2017/087216

PCT Pub. Date: May 26, 2017

(65) Prior Publication Data

US 2017/0260818 A1 Sep. 14, 2017

Related U.S. Application Data

(60) Provisional application No. 62/257,676, filed on Nov. 19, 2015.

(51) Int. Cl.
*E21B 19/14* (2006.01)

(52) U.S. Cl.
CPC ..... *E21B 19/14* (2013.01)

(58) Field of Classification Search
CPC ..... E21B 19/14
USPC ..... 175/85; 414/22.68, 22.71; 211/70.4
See application file for complete search history.

(56) References Cited

U.S. PATENT DOCUMENTS 2,148,058 A * 2/1939 Clark ..... E21B 19/14 211/70.4
2,507,040 A * 5/1950 Moore ..... E21B 19/14 211/70.4
3,612,286 A * 10/1971 Langowski ..... B65G 1/0442 175/85
3,616,941 A * 11/1971 Walling ..... B65G 1/0442 211/70.4
3,681,123 A * 8/1972 Reilly et al. ..... C11C 5/025 118/425
3,799,364 A * 3/1974 Kelly ..... E21B 19/14 175/85

(Continued)

FOREIGN PATENT DOCUMENTS

SU 1730422 A1 4/1992
WO 2005061839 A1 7/2005

*Primary Examiner* — Shane Bomar
(74) *Attorney, Agent, or Firm* — Rachel E. Greeene

(57) ABSTRACT

A casing racking module is located on a set-back platform at a forward edge of a drilling rig. The casing racking module has a casing frame forming rows for casing. Paddle assemblies are mounted on the casing frame. The paddle assemblies have a shaft, an arm pivotally located on the shaft, and a bumper pivotally located on the shaft. A rotary exit spring is located between the arm and the bumper. An arm stop limits rotation of the arm relative to the bumper. A rotary return spring is located between the bumper and the casing frame. A bumper stop aligns the bumper with the casing frame. An extendable gate opens from the end of each row.

9 Claims, 8 Drawing Sheets

(56) References Cited

U.S. PATENT DOCUMENTS

| | | | | |
|---|---|---|---|---|
| 4,042,123 | A | 8/1977 | Sheldon et al. | |
| 4,274,778 | A * | 6/1981 | Putnam | B25J 9/0084 175/85 |
| 5,575,344 | A * | 11/1996 | Wireman | E21B 19/14 175/162 |
| 8,961,093 | B2 * | 2/2015 | Springett | E21B 19/20 211/70.4 |
| 9,206,656 | B2 * | 12/2015 | Roodenburg | A47F 7/0028 |
| 2007/0017703 | A1 * | 1/2007 | Belik | E21B 19/155 175/52 |
| 2012/0018222 | A1 | 1/2012 | Hankins et al. | |
| 2012/0020758 | A1 | 1/2012 | Springett et al. | |
| 2013/0032405 | A1 | 2/2013 | Braxton | |
| 2015/0048038 | A1 | 2/2015 | Itrec | |
| 2019/0063167 | A1 * | 2/2019 | Kunec | E21B 19/14 |

* cited by examiner

CASING RACKING MODULE

CROSS REFERENCE TO RELATED APPLICATIONS

This application is a National Stage application of International Application No. PCT/US2016/061027 filed Nov. 9, 2016, which claims priority to United States Provisional Patent Application Ser. No. 62/257,676, filed Nov. 19, 2015, and having the same title. Both patent applications are incorporated by reference herein in their entirety.

BACKGROUND

In the exploration of oil, gas and geothermal energy, drilling operations are used to create boreholes, or wells, in the earth. The wells must be lined with casing to support the rough drilled sides of the well and to prevent them from caving in. Casing also protects subterranean water reservoirs from pollution from the drilling fluids, and from the oil and gas being produced. The casing program for a well requires casing operations to occur periodically throughout the drilling process. They start with a conductor pipe, followed by surface casing, intermediate casing, and ending with string of production casing which takes place during well completion.

Conventional casing is manufactured in lengths called sections or joints that are about 40 feet long. The sections of casing are screwed together to form casing "strings." Each end of a section of casing has male threads. A female threaded coupling is used to join the two male threaded sections together. Effort and equipment are expended to protect the threads of each casing section so that they may be securely connected to an adjacent casing section. Thread protectors are employed for this purpose.

Casing is run into the well from the drilling floor. Casing hangers are used to support the weight of the casing string at the top of the well. Centralizers are located on the casing to keep it centralized in the well.

Casing can be run into the well one section at a time, or in doubles or "stands" that are two sections of casing connected together in advance of running the casing in. Running stands is more time efficient as it eliminates the need to stop and connect 50% of the threaded connections. To run stands of casing, it is necessary to build them in advance, and to store them to be ready for use. Casing stands are conventionally stored vertically on the drill floor. Their upper ends are supported in the fingerboard of a mast-side racking module.

Thread protectors are used to protect the threads of casing sections. Handling individual thread protectors when running the casing string into the well takes time, as does managing the numerous thread protectors as they are removed. The need to run casing strings into the well faster creates additional problems as their positioning and alignment are primarily manual. There remains a need to control positioning of the lower end of casing stands in a manner that is accurate and protective of the casing threads.

SUMMARY

A casing racking module is disclosed that positions the lower end of casing sections or stands on a set-back platform in a manner that is accurate and protective of the casing threads. The casing racking module is provided on the front side of a drilling rig, directly beneath the stand racking module extending forward from the mast. The casing racking module may work in association with a stand racking module on the mast.

In one embodiment, the casing racking module has a casing frame. The casing frame forms a plurality of rows. Paddle assemblies are mounted on the casing frame. The paddle assemblies have a shaft, an arm pivotally located on the shaft, and a bumper pivotally located on the shaft.

A rotary exit spring between the arm and bumper resists rotation of the arm towards the bumper and urges the arm away from the bumper and against an arm stop. The arm stop limits rotational separation of the arm and the bumper.

A rotary return spring between the casing frame and bumper resist rotation of the bumper away from alignment with the casing frame and against a bumper stop. The bumper stop aligns the bumper with the casing frame as urged by the return spring.

In another embodiment, adjacent paddle assemblies are generally inverted on the shaft so as to provide clearance between adjacent arms from interfering with each other as casing sections or stands translate the rows of the casing racking module. In another embodiment, an extendable gate opens from an end of each row in the frame.

As will be understood by one of ordinary skill in the art, the assembly disclosed may be modified and the same advantageous result obtained. For example, reversing orientations of arms, paddles, springs and/or stops. It is further understood that the disclosed embodiments will function equally well with casing sections or stands, and reference to one is not indicated to exclude use with the other.

This summary is provided to introduce concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

The objects and features of the disclosed embodiments will become more readily understood from the following detailed description and appended claims when read in conjunction with the accompanying drawings in which like numerals represent like elements.

The drawings constitute a part of this specification and include exemplary embodiments, which may be embodied in various forms. It is to be understood that in some instances various aspects may be shown exaggerated or enlarged to facilitate an understanding of the embodiment.

DETAILED DESCRIPTION

The following description is presented to enable any person skilled in the art to make and use the disclosed embodiments, and is provided in the context of a particular application and its requirements. Various modifications to the disclosed embodiments will be readily apparent to those skilled in the art, and the general principles defined herein may be applied to other embodiments and applications without departing from the spirit and scope of the disclosure. Thus, the disclosed embodiments are not intended to be limited, but to be accorded the widest scope consistent with the principles and features disclosed herein.

Figure 1:
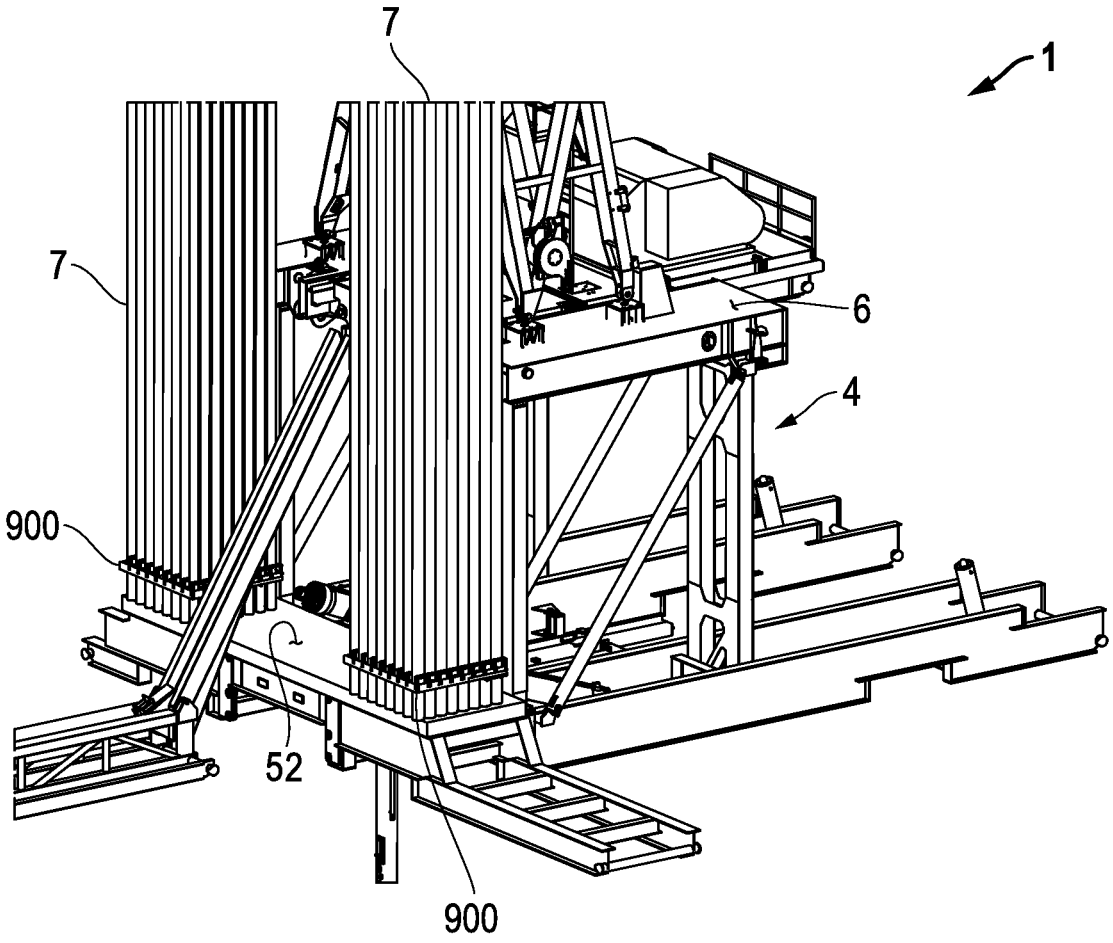
FIG. 1 is an isometric cut-away view of an embodiment of the casing racking module on a drilling rig, with casing in the casing racking module.

FIG. 1 is an isometric cut-away view of an embodiment of a casing racking module 900 on a drilling rig 1, with casing 7 in casing racking module 900. A set-back platform 52 is beneath casing racking module 900 on the front edge of drilling rig 1. In the embodiment illustrated, set-back platform 52 is located beneath the level of drill floor 6, near the front edge of the base box portion of substructure 4.

Figure 2:
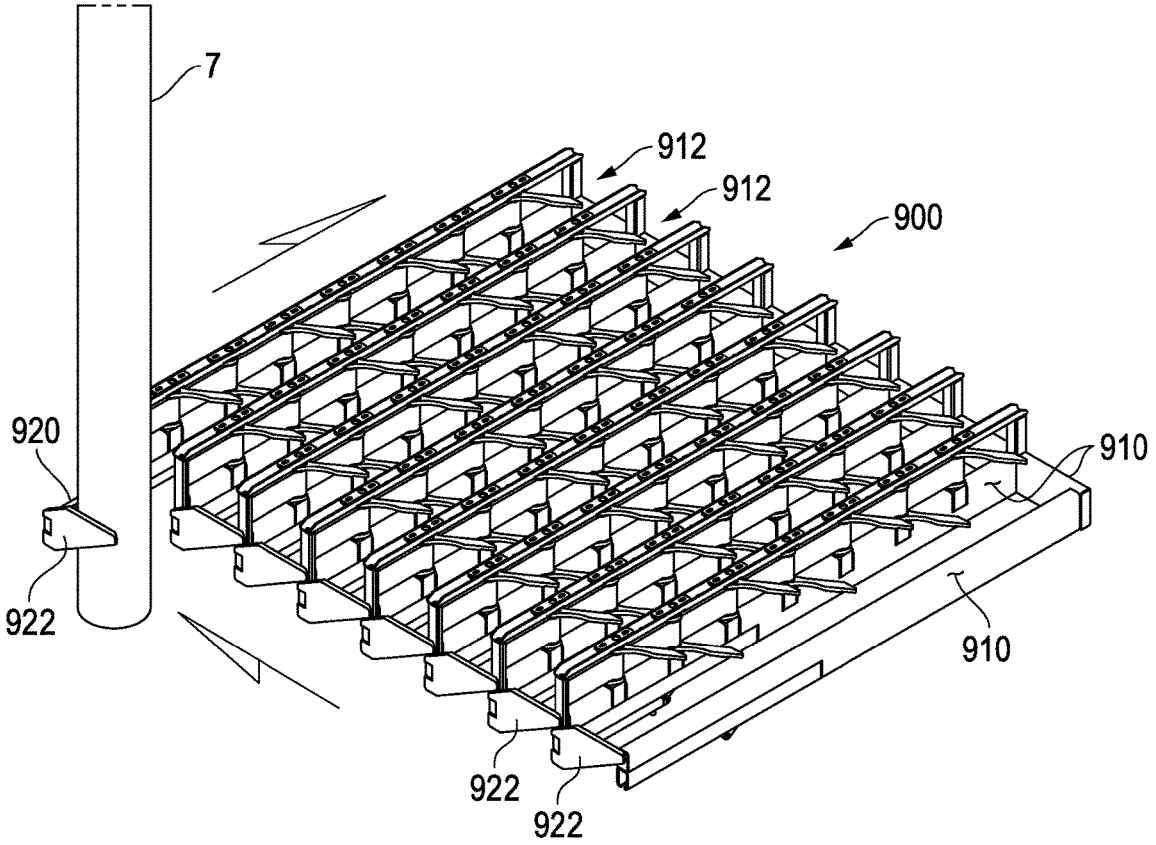
FIG. 2 is an isometric view of the casing racking module in accordance with one or more embodiments, shown in isolation of the drilling rig, and receiving a casing stand.

FIG. 2 is an isometric view of the embodiment of casing racking module 900 of FIG. 1 shown in isolation of drilling rig 1, and receiving a casing stand 7. Casing racking module 900 has a frame 910. Frame 910 forms a plurality of rows 912. The arrows show the direction of entry of casing stand 7 into casing racking module 900. An extendable gate 920 extends from frame 910. Extendable gate 920 has a door 922. Extendable gate 920 is provided at the entry end of each row 912. In FIG. 2, door 922 is shown as opened on a first row 912 to receive casing stand 7. Extendable gates 920 at the end of the other rows 912 remain closed and their doors 922 block undesired entry of casing stand 7 into any other row 912 of casing racking module 900. When extended, extendable gate 920 and door 922 trap casing stand 7 and direct it into the desired row 912.

Figure 3:
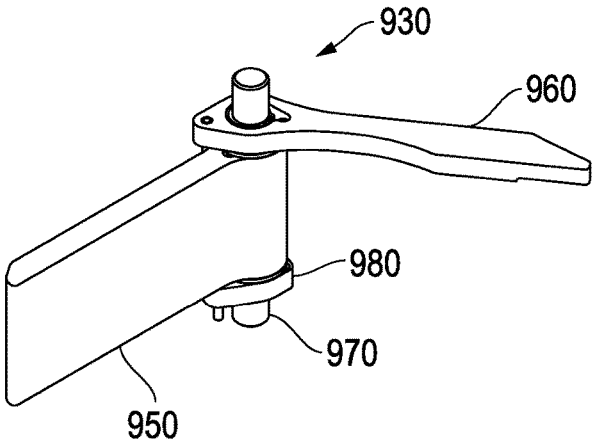
FIG. 3 is an isometric view of a paddle assembly component of the casing racking module in accordance with one or more embodiments.
Figure 4:
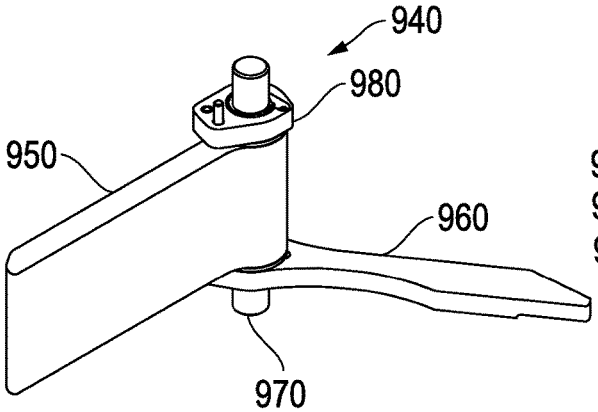
FIG. 4 is an isometric view of a paddle assembly component of the casing racking module in accordance with one or more embodiments.

FIG. 3 is an isometric view of a first paddle assembly 930 component of casing racking module 900. FIG. 4 is an isometric view of a second paddle assembly 940 component of casing racking module 900. In the embodiment illustrated, paddle assemblies 930 and 940 may be advantageously comprised of the same components. Paddle assemblies 930 and 940 may be combined to provide clearance between the arms 960 and the bumpers 950 of sequentially located paddle assemblies 930, 940. Referring to FIG. 3, first paddle assembly 930 has an arm 960 and a bumper 950 pivotally mounted on a shaft 970. A bowl 980 is mounted beneath bumper 950. Referring to FIG. 4, second paddle assembly 940 also has an arm 960 and a bumper 950 pivotally mounted on a shaft 970, except bumper 950 is mounted above arm 960, and bowl 980 is mounted above bumper 950.

In each paddle assembly 930 and 940 configuration, the function of arm 960 is to engage an incoming casing section or stand 7, and to cause bumper 950 to follow behind casing 7 as it progresses through row 912. The purpose of bumper 950 is to provide a cushioned protective interference between adjacent casing 7 such that their respective threaded connections will not impact each other during the racking and unracking procedure.

Figure 5:
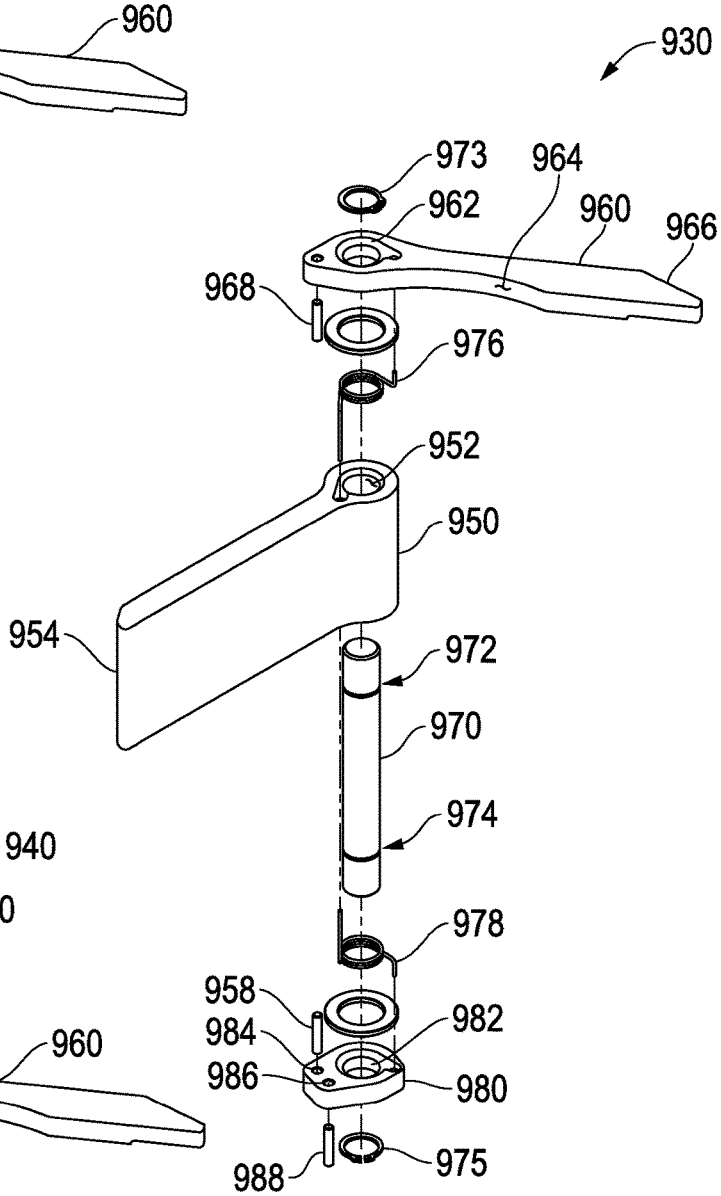
FIG. 5 is an exploded view of the paddle assembly of FIG. 3.

FIG. 5 is an exploded view of first paddle assembly 930. In the embodiment illustrated, paddle assembly 930 has a shaft 970 having an upper snap ring groove 972 for receiving a snap ring 973 and a lower snap ring groove 974 for receiving snap ring 975 to hold paddle assembly 930 components in place on shaft 970. Bumper 950 has an orifice 952 through which bumper 950 is pivotally positioned on shaft 970. Bumper 950 may have a beveled edge 954 as shown. Beveled edge 954 may operate to avoid interference of bumper 950 with other components casing racking module 900.

Arm 960 has an orifice 962 through which arm 960 is pivotally positioned on shaft 970. Arm 960 is located above bumper 950. Arm 960 may have a relief 964 on a side facing bumper 950. Relief 964 limits the rotation of arm 960 when engaging casing 7. Arm 960 may have a chamfered edge 966 on the side opposite bumper 950. Chamfered edge 966 may operate to avoid interference of arm 960 with other components casing racking module 900 and/or to limit the rotation of arm 960 when engaging casing 7.

A torsional exit spring 976 may be engaged between arm 960 and bumper 950 to resist rotation of arm 960 towards bumper 950. An arm stop 968 extends between arm 960 and bumper 950 to limit separating rotation between arm 960 and bumper 950.

A torsional return spring 978 may be engaged between bumper 950 and frame 910 to resist rotation of bumper 950 away from alignment with frame 910. A bumper stop 958 limits rotation of bumper 950 to align paddle assembly 930 to its natural resting position.

In one embodiment, a bowl 980 has an orifice 982 through which bowl 980 is positioned on shaft 970. In one embodiment, bowl 980 is positioned below bumper 950 and held in position relative to frame 910, such as by a paddle pin 988 through a pin hole 986 or similar means. Bowl 980 may receive torsional return spring 978 that connects to bumper 950. Bowl 980 may also support bumper stop 958 such as through a stop hole 984 or similar means. In another embodiment (not shown), the functional features of bowl 980 may be machined into casing frame 910 and/or a rail 926 (see FIG. 8).

Snap rings 973 and 975 engage upper snap ring groove 972 and lower snap ring groove 974 to hold paddle assembly 930 together, although it will be understood by a person of ordinary skill in the art that there are many fastener and attachment alternatives to snap rings for this purpose.

Figure 6:
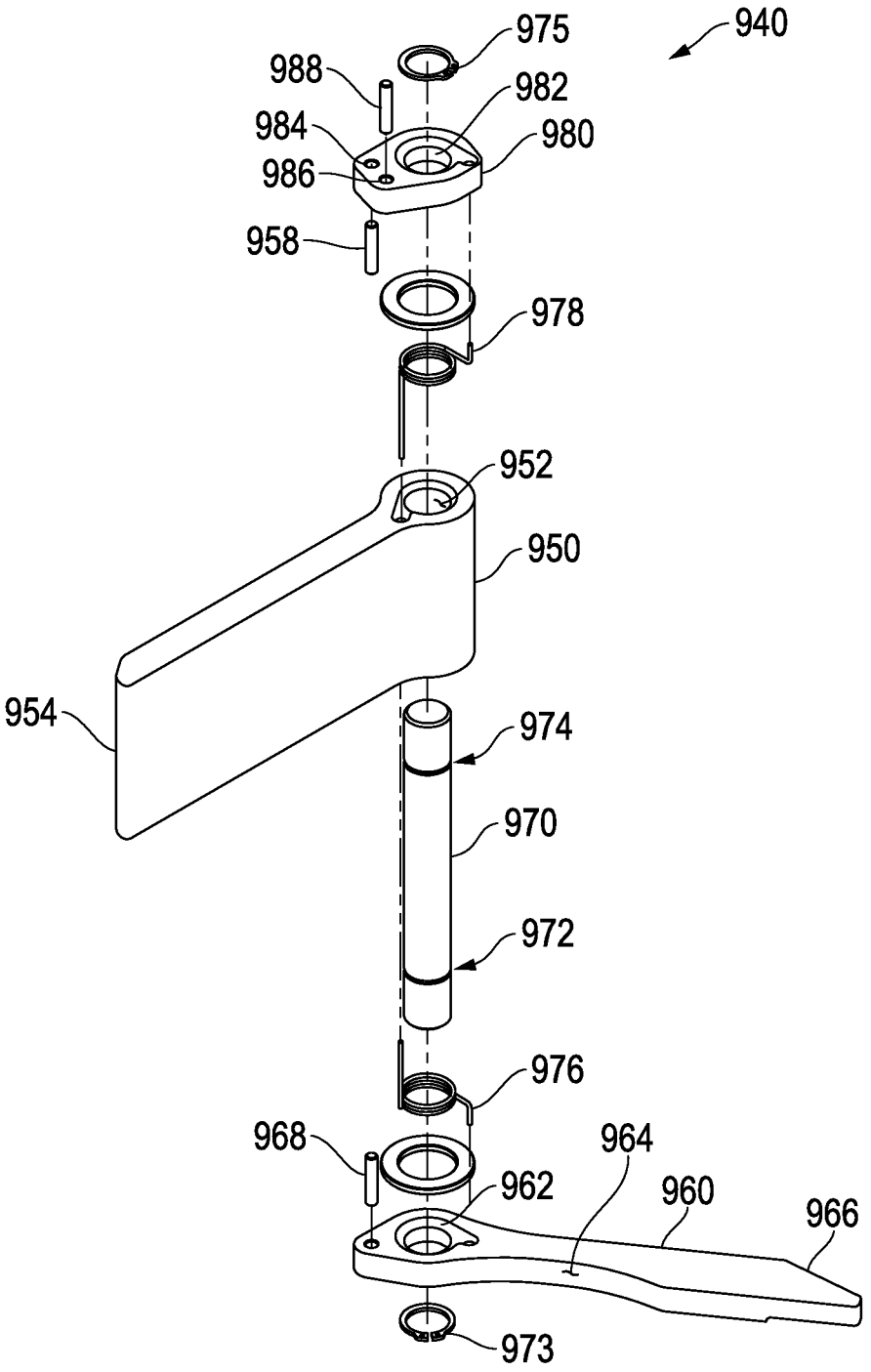
FIG. 6 is an exploded view of the paddle assembly of FIG. 4.
Figure 7:
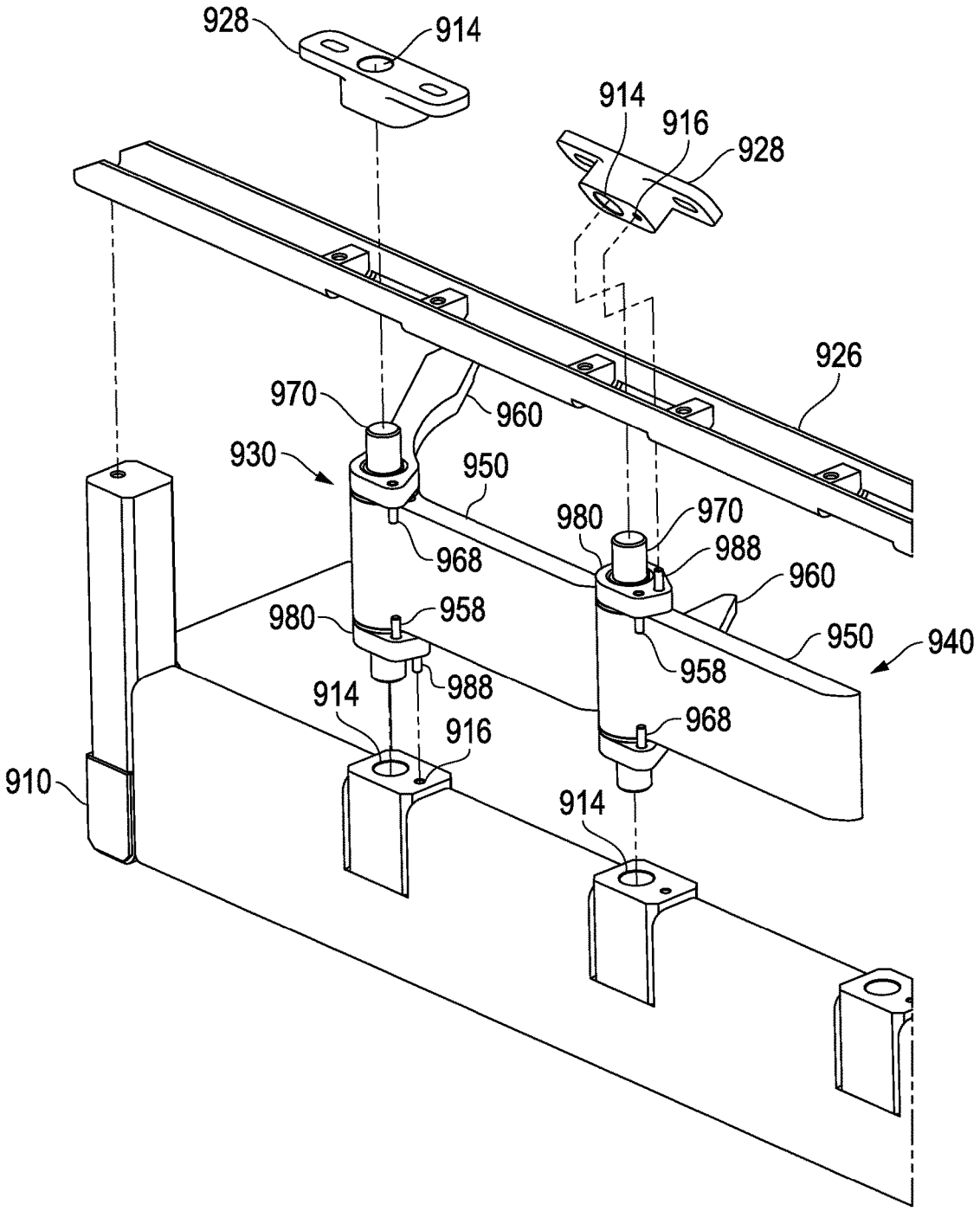
FIG. 7 is a partially exploded view of the casing racking module in accordance with one or more embodiments.

FIG. 6 is an exploded view of second paddle assembly 940. As seen by comparison to FIG. 5, paddle assembly 940 is essentially inverted. In this embodiment, as also seen in FIG. 7, paddle pin 988 extends upwards to locate and fix bowl 980 in relationship to a rail 926 (see FIG. 8). In this manner, return spring 978 is compressed in response to rotation of bumper 950 away from alignment with frame 910.

FIG. 7 is a partially exploded view illustrating the connective relationship between paddle assemblies 930, 940, rail 926 and frame 910. Frame 910 and rail 926 each have shaft receptacles 914 for receiving shaft 970 of both paddle assemblies 930 and 940. Similarly, frame 910 and rail 926 each have paddle locate receptacles 916 for receiving paddle pins 988 of both paddle assemblies 930 and 940. Paddle pins 988 lock bowls 980 in non-rotating alignment with frame 910, and in desired alignment with frame 910 and rows 912. This renders bowl 980, if used, a non-moving extension of frame 910.

Figure 8:
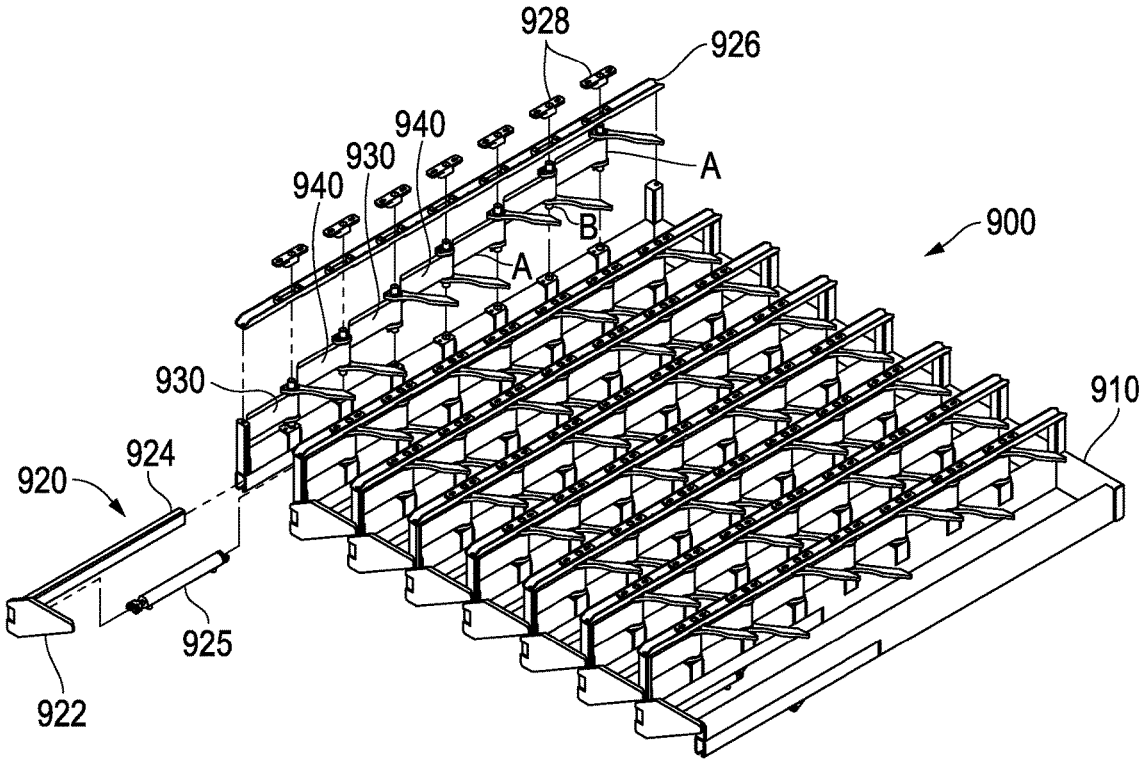
FIG. 8 is a partially exploded view of the casing racking module in accordance with one or more embodiments, illustrating a row having alternating paddle assemblies.

FIG. 8 is a partially exploded view of an embodiment of casing racking module 900, illustrating extendable gate 920 removed and with its extension 924 and its actuator 925 visible. A row of paddle assemblies 930 and 940 are shown assembled in alternating arrangement. A rail 926 is used to secure paddle assemblies 930 and 940 in place on frame 910. Rail 926 is secured to frame 910 with fasteners 928 or other means.

Figure 9:
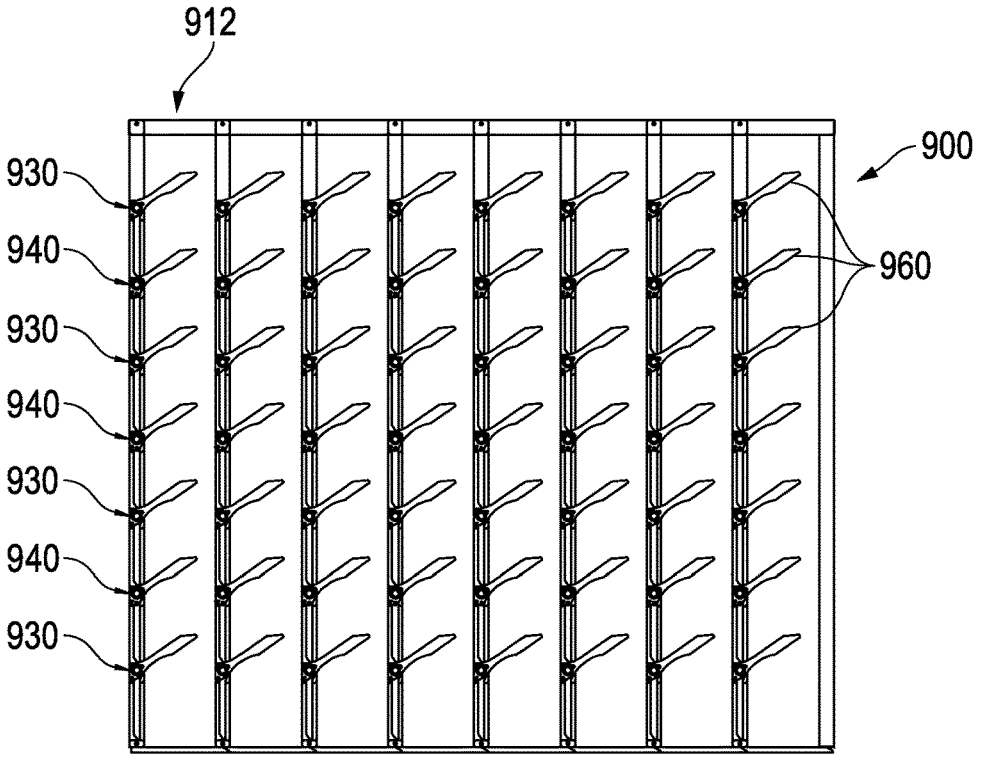
FIG. 9 is a top view of an embodiment of the casing racking module, illustrating the casing racking module empty of casing, and illustrating a typical row having alternating paddle assemblies with arms extending into the rows to engage incoming casing.

FIG. 9 is a top view of an embodiment of casing racking module 900, illustrating casing racking module 900 empty of casing 7 and illustrating a typical row 912 having alternating paddle assemblies 930 and 940. Without casing 7 in place, arms 960 extend into rows 912 as shown.

Figure 10:
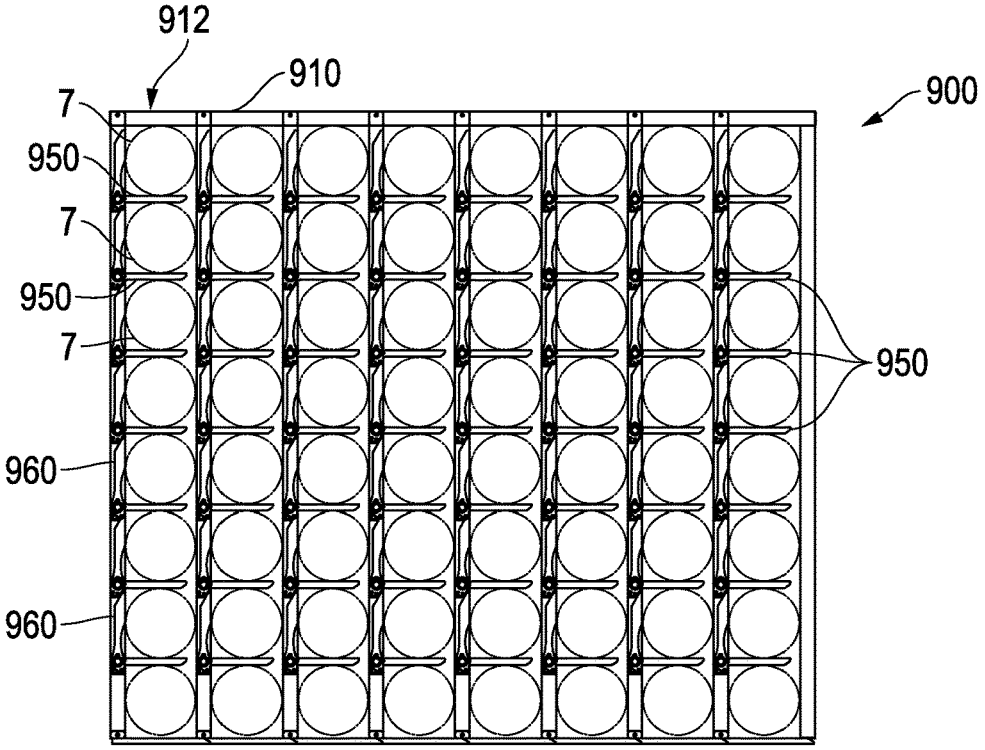
FIG. 10 is a top view of an embodiment of the casing racking module, illustrating the casing racking module filled with casing, and illustrating the positioning of the thread-protecting bumpers between the racked casing.

FIG. 10 is a top view of an embodiment of casing racking module 900, illustrating casing racking module 900 filled with casing 7, and illustrating the positioning of bumpers 950 between casings 7 to protect the threads of adjacent casings 7 from contact damage.

Figure 11:
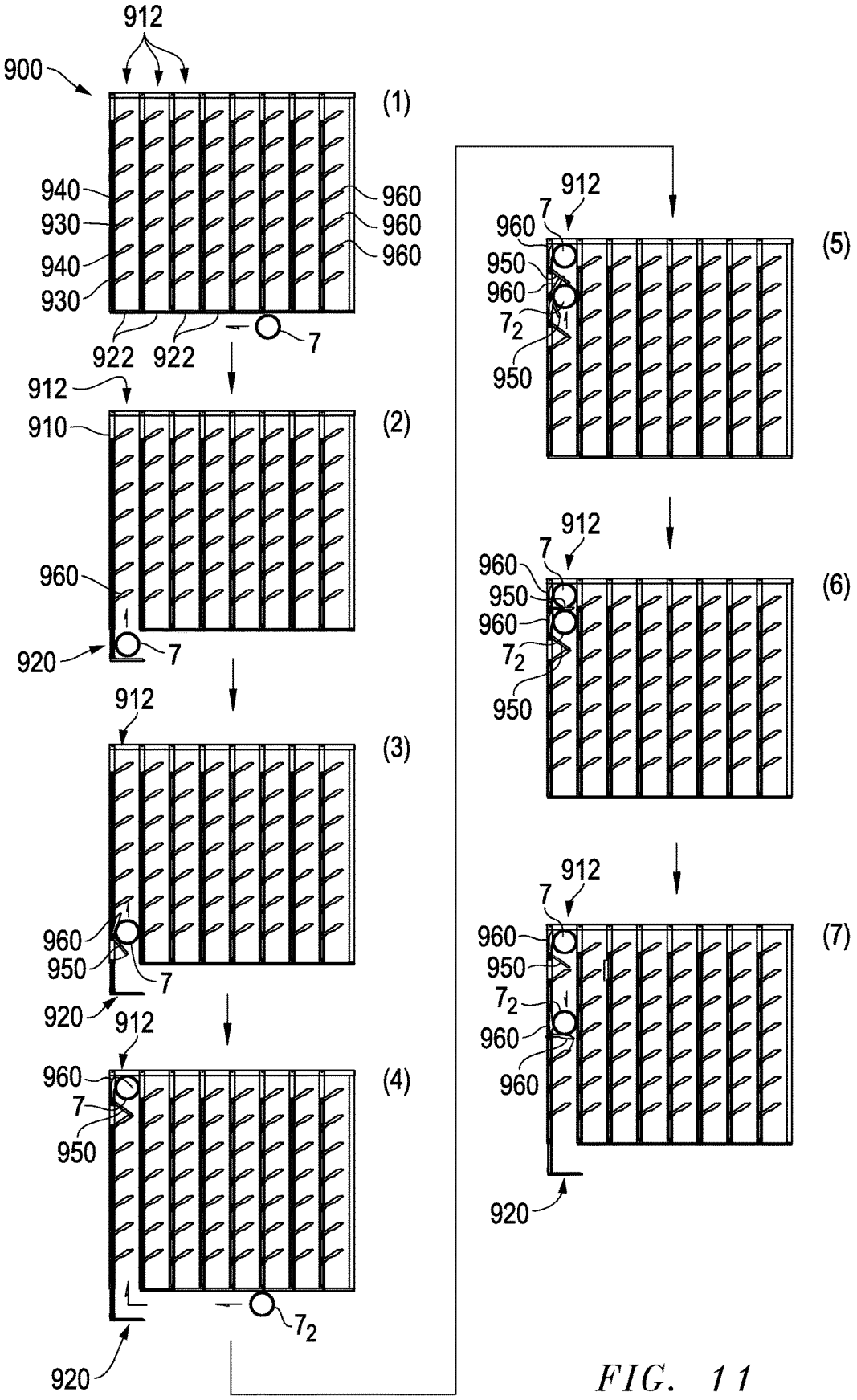
FIG. 11 is a top view of a sequence of steps (1) through (7) of racking two stands of casing and then removing the last casing stand racked in accordance with one or more embodiments of the casing racking module.

FIGS. 11(1) through 11(7) are top views of a sequence of racking two stands of casing 7 in the casing racking module 900, and then removing the last stand racked.

In FIG. 11(1), a casing stand 7 is moving along the outside of casing racking module 900. Extendable gates 920 are closed, and doors 922 prevent casing 7 from entering casing racking module 900. Arms 960 extend over rows 912 in this view in a first arm position while bumpers 950 are aligned over casing frame 910 in a first bumper position (see FIG. 9).

In FIG. 11(2), extendable gate 920 has been opened to capture casing 7 and to permit casing 7 to proceed into that row 912.

In FIG. 11(3), casing 7 is proceeding through row 912. As casing 7 engages each arm 960, it forces rotation of arm 960. As arm 960 rotates, arm stop 968 engages bumper 950 causing bumper 950 to rotate along with arm 960.

In FIG. 11(4), casing 7 has passed each arm 960 to reach the top of row 912. As casing 7 engages each arm 960, it forces rotation of each arm 960 into a second arm position in alignment with casing frame 910. As arms 960 are being rotated towards the second arm position, arm stops 968 engage bumpers 950, causing bumpers 950 to rotate with arms 960, and causing return springs 978 to be compressed.

As casing 7 then passes by each arm 960, the energy in return springs 978 forces bumpers 950 to rotate in the opposite direction and back up against bumper stops 958 and back into alignment with frame 910 in the first bumper position. The return rotation of bumpers 950 is translated through arm stops 968 to rotate arms 960 back into the first arm position. Also in FIG. 11(4), second casing $7_2$ is moving along the outside of casing racking module 900 towards open extendable gate 920.

In FIG. 11(5), second casing $7_2$ is moving up row 912 in the same manner as the previous casing 7 did. As casing $7_2$ approaches casing 7, it encounters and engages bumper 950 which is suspended in row 912 by the force of casing 7 on its connected arm 960.

In FIG. 11(6), casing 7 presses arm 960 into the second arm position. Second casing $7_2$ has moved fully forward in row 912 and pushed bumper 950 from the second bumper position into a third bumper position. In the third bumper position, bumper 950 extends generally perpendicular to casing frame 910 to separate casing 7 from second casing $7_2$. In this manner, each adjacently racked casing 7 has its threads protected by bumpers 950. When casing racking module 900 is full, arms 960 are pushed by casing 7 into alignment with casing frame 910 and bumpers 950 extend into rows 912 between casing 7 (see FIG. 10).

In FIG. 11(7), second casing $7_2$ has begun to exit casing racking module 900. As second casing $7_2$ exits row 912, it sequentially engages arms 960. Arms 960 are rotated towards bumpers 950 until arms 960 are aligned with bumpers 950 and casing frame 910 in a third arm position, with the bumpers 950 back in the first bumper position. The third arm position compresses exit springs 976. As second casing $7_2$ passes arms 960, the energy in exit springs 976 forces arms 960 to rotate away and against arm stops 968 back in their first arm position extending into row 912 (see FIG. 9).

If used herein, the term "substantially" is intended for construction as meaning "more so than not."

Having thus described certain embodiments, it is noted that the embodiments disclosed are illustrative rather than limiting in nature and that a wide range of variations, modifications, changes, and substitutions are contemplated in the foregoing disclosure and, in some instances, some features may be employed without a corresponding use of the other features. Many such variations and modifications may be considered desirable by those skilled in the art based upon a review of the foregoing description. Accordingly, it is appropriate that the appended claims be construed broadly and in a manner consistent with the scope of the disclosed embodiments.

The invention claimed is:

1. A casing racking module (900), comprising:

a casing frame (910) forming a plurality of rows (912);

a plurality of arms (960) pivotally connected to the frame (910) and pivotal between a first arm position and a second arm position;

the arms (960) extending into the rows (912) in the first arm position;

the arms (960) extending over the casing frame (910) in the second arm position;

a plurality of bumpers (950) pivotally connected to the frame (910) and pivotal between a first bumper position and a second bumper position;

the bumpers (950) extending over the casing frame (910) in the first bumper position;

the bumpers (950) extending into the rows (912) in the second bumper position;

an extendable gate at the end of a row; and a door attached to the extendable gate.

2. A casing racking module (900), comprising:

a casing frame (910) forming a plurality of rows (912);

a plurality of arms (960) pivotally connected to the frame (910) and pivotal between a first arm position and a second arm position;

the arms (960) extending into the rows (912) in the first arm position;

the arms (960) extending over the casing frame (910) in the second arm position;

a plurality of bumpers (950) pivotally connected to the frame (910) and pivotal between a first bumper position and a second bumper position;

the bumpers (950) extending over the casing frame (910) in the first bumper position; and the bumpers (950) extending into the rows (912) in the second bumper position wherein the arm and the bumper pivotally mounted on a shaft form a paddle assembly.

3. The casing frame of claim 2, further comprising:

a first paddle assembly having the arm mounted above the bumper;

a second paddle assembly having the bumper mounted above the arm; and, the first and second paddle assemblies being mounted on the casing frame in alternating relationship.

4. A casing racking module (900), comprising:

a casing frame (910) forming a plurality of rows (912);

a plurality of arms (960) pivotally connected to the frame (910) and pivotal between a first arm position and a second arm position;

the arms (960) extending into the rows (912) in the first arm position;

the arms (960) extending over the casing frame (910) in the second arm position;

a plurality of bumpers (950) pivotally connected to the frame (910) and pivotal between a first bumper position and a second bumper position;

the bumpers (950) extending over the casing frame (910) in the first bumper position;

the bumpers (950) extending into the rows (912) in the second bumper position;

the bumper pivotal in a first rotational direction from the first bumper position to the second bumper position;

the bumper in the second bumper position rotated in the first direction to a third bumper position perpendicular to the casing frame wherein the bumper is rotated from the first bumper position to the second bumper position by engagement with an arm stop and rotation of the arm and wherein the bumper is rotated from the second bumper position to the third bumper position by engagement with casing moved into the casing racking module.

5. A casing racking module (900), comprising:

a casing frame (910) forming a plurality of rows (912);

a plurality of arms (960) pivotally connected to the frame (910);

a plurality of bumpers (950) pivotally connected to the frame (910);

a torsional exit spring (976) compressible on rotation of the arm (960) towards the bumper (950);

a torsional return spring (978) compressible on rotation of the bumper (950) away from alignment with the casing frame (910); and an extendable gate at the end of a row; and, a door attached to the extendable gate.

6. A casing racking module (900), comprising:

a casing frame (910) forming a plurality of rows (912);

a plurality of arms (960) pivotally connected to the frame (910);

a plurality of bumpers (950) pivotally connected to the frame (910);

a torsional exit spring (976) compressible on rotation of the arm (960) towards the bumper (950);

a torsional return spring (978) compressible on rotation of the bumper (950) away from alignment with the casing frame (910);

wherein the arm and the bumper pivotally mounted on a shaft form a paddle assembly.

7. A casing racking module (900), comprising:

a casing frame (910) forming a plurality of rows (912);

a plurality of paddle assemblies (930, 940) mounted on the casing frame (910), comprising;

a shaft (970);

an arm (960) pivotally located on the shaft (970);

a bumper (950) pivotally located on the shaft (970);

a torsional exit spring (976) located on the shaft (970) and compressible on angular approach of the arm (960) and the bumper (950);

an arm stop (968) extending between the arm (960) and the bumper (950), the arm stop (968) limiting angular separation of the arm (960) relative to the bumper (950);

a torsional return spring (978) located on the shaft (970) and compressible on angular separation of the bumper (950) and the casing frame (910); and, a bumper stop (958) extending between the bumper (950) and the casing frame (910), the bumper stop (958) aligning the bumper (950) to the casing frame (910).

8. The casing racking module of claim 7, further comprising:

a plurality rows formed in the frame; and, an extendable gate at the end of each row.

9. The casing racking module of claim 7, further comprising:

a first paddle assembly having the arm mounted above the bumper;

a second paddle assembly having the bumper mounted above the arm; and, the first and second paddle assemblies being mounted on the casing frame in alternating relationship.

* * * * *